US008832978B2

(12) United States Patent
Seidl

(10) Patent No.: US 8,832,978 B2
(45) Date of Patent: Sep. 16, 2014

(54) LABEL FOR STICKING ONTO A CONTAINER FOR A LIQUID DRUG AND CONTAINER

(75) Inventor: Peter Seidl, Munich (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 117 days.

(21) Appl. No.: 13/065,419

(22) Filed: Mar. 22, 2011

(65) Prior Publication Data

US 2011/0233095 A1 Sep. 29, 2011

(30) Foreign Application Priority Data

Mar. 26, 2010 (DE) ..... 10 2010 013 040

(51) Int. Cl.

| | |
|---|---|
| ***G09F 3/00*** | (2006.01) |
| ***G09F 3/10*** | (2006.01) |
| *G09F 3/02* | (2006.01) |

(52) U.S. Cl.

CPC ..... *G09F 3/10* (2013.01); *G09F 2003/0251* (2013.01); *G09F 2003/0222* (2013.01); *G09F 2003/0272* (2013.01); *G09F 3/0288* (2013.01); *G09F 2003/0229* (2013.01)

USPC ..... 40/310

(58) Field of Classification Search

USPC ..... 40/310, 306; 283/81, 105, 900

See application file for complete search history.

(56) References Cited

U.S. PATENT DOCUMENTS

| | | | | |
|---|---|---|---|---|
| 5,172,936 | A * | 12/1992 | Sullivan et al. | 283/81 |
| 5,342,093 | A * | 8/1994 | Weernink | 283/81 |
| 6,047,488 | A * | 4/2000 | Tuszkiewicz | 40/306 |
| 6,193,279 | B1 | 2/2001 | Seidl | |
| 6,332,631 | B1 | 12/2001 | Kirk | |
| 7,448,153 | B2 * | 11/2008 | Maliner et al. | 40/310 |
| 2010/0215876 | A1 | 8/2010 | Seidl | |

FOREIGN PATENT DOCUMENTS

| | | |
|---|---|---|
| DE | 295 03 712 | 6/1995 |
| DE | 19746011 | 10/1997 |
| DE | 297 21 217 | 5/1998 |
| DE | 196 50 720 | 6/1998 |
| DE | 297 12 616 | 12/1998 |
| DE | 299 06 832 | 10/2000 |
| DE | 200 19 432 | 5/2002 |
| DE | 20 2007 007 184 | 10/2007 |
| DE | 102009001206 | 9/2010 |
| EP | 0 463 193 | 1/1992 |
| EP | 0 731 434 | 5/1998 |
| EP | 1 276 089 | 1/2003 |
| GB | 2238772 A * | 6/1991 |

* cited by examiner

*Primary Examiner* — Joanne Silbermann

(74) *Attorney, Agent, or Firm* — Collard & Roe, P.C.

(57) ABSTRACT

A label (1) for sticking onto a container for a liquid drug is provided, wherein the label (1) is a single-layer wrap-around label for wrapping around a circumference of a container, wherein the label (1) has a spare label (10) that forms a detachable part portion of the label (1), and a first label portion (11) for covering the spare label (10) and wherein the spare label (10) is arranged in a surface region of the label (1) that differs from the first label portion (11).

16 Claims, 3 Drawing Sheets

LABEL FOR STICKING ONTO A CONTAINER FOR A LIQUID DRUG AND CONTAINER

CROSS REFERENCE TO RELATED APPLICATIONS

Applicant claims priority under 35 U.S.C. §119 of German Application No. 10 2010 013 040.0 filed Mar. 26, 2010, the disclosure of which is incorporated by reference.

BACKGROUND OF THE INVENTION

1. Field of the Invention

The invention relates to a label for sticking onto a container for a liquid drug and to such a container.

2. The Prior Art

In medicine, liquid drugs that are intended to be administered by means of injection, are transported and handled in transparent containers, so-called ampoules or vials, finally being removed from said containers. Such containers are usually produced from glass, have a cylindrical circumferential surface and an upper side through which an injection needle can pass. A certain quantity of liquid is removed from the container either once or several times depending on the type of application and the drug selected. All these containers have to be inscribed by means of suitable labels in order to identify the precise content, its composition, concentration and/or quantity, etc.

These types of containers often only contain a few milliliters of liquid in the filled state. Whilst multi-dose containers, which are intended for the multiple removal of, in each case, a part quantity of the liquid, typically contain about 10 ml of liquid, single-dose containers for one-off use are clearly even smaller and contain only approximately between 1 and 3 ml. On account of the small quantity of liquid required, the diameter of such single-dose containers and the circumference of the cylindrical outside surface thereof is relatively small, and through the small circumference of the cylindrical outside surface, the surface that can be written on, on which all the information for identifying the container content (including trade names, composition, quantity or concentration specifications, barcode, expiry dates, any warnings or further specifications) is to be accommodated on the label, is very small.

In addition, it would be desirable for these types of labels to have a detachable label part that could be stuck onto the syringe or onto the actual circumferential face thereof directly after a syringe has been filled with the liquid in order to identify the syringe content. On this label part now attached to the syringe, for example, the dose removed or other data identifying the individual treatment can be noted. To this end, inscription surfaces that can be written on subsequently by hand should be provided on the detachable label part to be attached to the syringe in order to identify the syringe individually until it is administered.

Such a detachable label part for the syringe, in this case called a spare label, reduces the remaining surface available for the entire label, on which surface the specifications for identifying the liquid container itself, namely the ampoule or the vial, are to be accommodated.

The lack of space this generates for the specifications to be accommodated on the label turns out to be even more drastic if the ampoule or the vial is a container for a single dose; in this case the outside circumference of the container turns out to be even smaller.

In particular in the case of labels for identifying containers of such drugs that are high risk (for instance in the case of anaesthetics or heparins)—in particular where there are administering errors on account of confusing names, compatibility problems or wrong dosage—the label surface that is conventionally available is often insufficient in order to accommodate the administering and safety instructions for the medical personnel on the label with the desired clarity, type size and/or detail.

SUMMARY OF THE INVENTION

It is the object of the present invention to provide a label that has a larger inscription surface for information to identify a liquid container (in particular a container for a liquid drug). In addition, the label is to be producible with less work and less costs in spite of the larger inscription surface. At the same time, the label is to be composed such that relevant information is better perceived by the medical experts, in particular in the hustle and bustle of the typical day in medicine.

This object is achieved according to the invention by a label for sticking onto a container for a liquid drug, wherein the label is a single-layer wrap-around label for wrapping around a circumference of a container, wherein the label has a spare label that forms a detachable part portion of the label, and a first label portion for covering the spare label (10) and wherein the spare label is arranged in a surface region of the label that differs from the first label portion.

According to the invention, a label is provided that, although providing clearly more inscription surface for accommodating text, graphic and/or symbolic identification elements, is formed as a single-layer label, i.e. is formed from only one single material layer. In particular, differently to multiple-layer labels, the spare label is not provided in the form of a stuck-on additional further material layer or film, but forms an integral component of the label or of the material layer thereof. The spare label is separated from the surrounding remainder of the (mother) label, for example, by a surrounding perforation, punched line or another tear line (or by many tear elements that are arranged along a planned tear line) in the material of the single-layer wrap-around label.

As the label is single-layer, there is no need for the additional expenditure incurred to produce multiple-layer labels. However, the provision of sufficiently large inscription surfaces is initially made more difficult by the restriction to only one material layer.

The label according to the invention is, however, realized as a wrap-around label, i.e. its length is matched to the container to be identified and corresponds to a multiple of the circumference of the container to be labelled. Such a label is stuck onto the outside surface of the container in a circumferential manner.

In this case it would be expected that the spare label would be realized at the outermost end of the label in the circumferential direction as a protruding flag and consequently be easily grippable and easy to peel off. So that, however, not only the outer circumference of the container is available for identifying the container content, the label according to the invention deviates from this in several points.

Firstly, the spare label, which will serve to identify the injection syringe, cannot be peeled off from the outer end of the label, although it would be the easiest place to grip it. Instead of which, the spare label according to the invention is arranged in another, preferably central label portion that is remote from the outer first label portion at the end.

The spare label is additionally arranged within the label surface such that it is covered on the dispensed label by the first label portion. As the label according to the invention is a wrap-around label, the first label portion at the end has a length that (in the longitudinal direction of the produced, not yet dispensed label or in the circumferential direction of the labelled container) is at least as large as the length of the spare label. Once the entire label has been dispensed in the agreed manner, its spare label is consequently initially not yet accessible and as a rule also not yet visible.

Thirdly, the spare label is defined on at least two or three sides by a perforation or another tear line; in particular, the spare label is formed from the same material web as the surrounding, remaining label surface of the entire label.

Both the positioning of the spare label to one side of the first label portion at the end which is actually easier to access, and the incorporating of the spare label as an integral component of the single-layer label as well as also the covering of the spare label by the first label portion initially make access more difficult to the spare label to be detached in the agreed manner from the entire label. Consequently, the entire label according to the invention deviates in its structure immediately in many respects from such forms of label that the expert would perhaps deem as obvious.

The advantage of the label according to the invention is that, in spite of the simplest style and production, clearly more inscribable label surface is available. For by the detachable spare label being initially covered along the container circumference by the first label portion, as soon as the label has been dispensed, the spare label is accessed by the first label portion at the end being initially raised from the circumference of the container and consequently also from the spare label. This means, however, that the first label portion now protrudes as a flag from the outside surface of the container and additionally also exposes the label surface located below it that completely runs around the circumference of the container (and contains the now accessible spare label).

As it is inscribable on the front side and on the rear side, the first label portion, which can be raised as a flag, has an inscribable length that corresponds to twice the circumference of the labelled container. The following label surface exposed below this flag corresponds once again to the complete circumference of the liquid container. The inscription surface available on account of the flag being inscribable on both sides is already at least twice as large as the entire circumferential surface of the liquid container. Consequently, considerably more information can be accommodated than in the past, and the surface gain obtained here for the inscription field by the label according to the invention is not easily achievable otherwise even by labels constructed with multiple layers. Application instructions or warnings for the medical experts can be accommodated more easily on the rear side of the first label portion at the end, now obtained for labelling, and can also be developed such that they are afforded greater attention in the hustle and bustle of medical working practice. For example, some of the instructions or labelling parts can be enlarged or can even be printed more than once, namely on the front side and on the rear side of the first label portion, for instance in order to emphasize circumstances that are particularly relevant to risk.

It is preferably provided that the single-layer label has a material web and that the spare label is a detachable part portion of the material web. The spare label is consequently an integral component of the single-layer label or of the material web or material layer thereof. This means that when the spare label is subsequently removed, a partial gap is generated, i.e. an at least one-sided recess and consequently constriction in the material web of the label such that once the spare label has been peeled off only a narrower region of the label remains. The label according to the invention, in spite of the spare label being incorporated in the single material layer of the entire label, is consequently able to be produced, manipulated and dispensed without complications.

Contrary to multiple-layer labels, the label according to the invention has just only one single material layer. The term material layer in this case refers to a film (usually made of plastics material, or alternatively of paper) that is itself sufficiently deformation resistant, tear resistant and thick in order to enable reliable handling during production and labelling. Such a material layer is to be differentiated from print, anti-adhesive coatings or adhesive layers, which as a thin film do not have any sufficient inherent deformation resistance, as long as they are not pushed, pressed or applied in any other way onto a substrate (for instance onto a film). In spite of such adhesive layers, anti-adhesive coatings and/or print, a single-layer label in terms of this application is consequently such a label that has only one single material web (in particular film) that has sufficient stability, inherent strength and/or deformation resistance in order to be individually manipulatable.

It is preferably provided that the spare label is arranged in a central second label portion which is intended to be covered by the first label portion. Differently from what is otherwise usual for wrap-around labels, according to the invention the spare label is not exposed in the region of the second label portion until the first label portion has been opened and can then be removed. The spare label can assume practically the entire base surface of the second label portion, in particular it can extend around the complete circumference of the labelled object.

It is preferably provided that the first and the second label portion are arranged consecutively and/or adjoining one another along a longitudinal direction of the label, along which the label is to roll off for dispensing. The term longitudinal direction of the label in this case refers to that direction, along which the label is rolled on the object to be labelled or on the circumferential surface thereof (or is rolled off from the previous support roller). This longitudinal direction of the label corresponds consequently to the subsequent circumferential direction of the labelled container. In the case of an ampoule or a vial, the dimension of the label along this longitudinal direction is greater than in the direction transversely relative thereto, which in this case is denoted as the vertical direction. Consequently, the longitudinal direction of the label at the same time corresponds to the main direction of extension of the label. The wrap-around label is provided, in particular, for wrapping around the circumference of the liquid container more than two times. The first label portion is situated at that end located in the longitudinal direction that is rolled out last onto the circumference of the liquid container when dispensed. The second label portion, however, is situated in a central region, from which the spare label is to be subsequently detached. Between the two label portions there is an optional transition region, onto which the outermost end of the first label portion can be adhered.

It is preferably provided that the label has a third label portion, which is arranged at an end of the label opposite to the first label portion, is adhesive on the rear side and is provided on the front side with a anti-adhesive coating. After the label has been dispensed, the third label portion serves as a substrate for the second adhesively-backed surface portion of the spare label. The third label portion covered with a anti-adhesive coating makes it possible for the spare label, which is to be stuck firmly to the syringe permanently, to be able to be easily detached initially from the entire label on the circumference of the liquid container.

The label is preferably realized such that, in the dispensed state, the first label portion can be raised to form a protruding and/or re-sealable flag. This label part can consequently be inscribed and read on both sides. In particular, if the length of the first label portion corresponds to the circumference of the liquid container, twice as much information can be accommodated on it than on the circumference of the container itself. Thus, for example, warnings can be accommodated with greater clarity or detail, for example even twice on the front side and the rear side of the first label portion that can be raised to form a flag.

The first label portion is preferably printed on and/or can be printed on on both sides. In addition, the first label portion is preferably non-adhesive over a large surface area on its rear side. Finally, the label or the material web thereof (or at least the first label portion thereof) is preferably non-transparent, for example white. This can be realized, for instance by a film that is already non-transparent per se or alternatively by a non-transparent, large-area (on the front and/or rear side) background print on a film formed from transparent material.

It is preferably provided that along the longitudinal direction of the label, the length of the first label portion is dimensioned such that the first label portion completely encircles the circumference of the object to be labelled or of the labelled object and the spare label is not exposable until the first label portion has been raised.

The label is preferably realized such that an edge region at the end of the first label portion is re-sealable, in particular is adhesive on the rear side. The end-side edge region is located, for example, on the edge terminating the label in the longitudinal direction, on the one that is visible after dispensing. The edge region directly adjoining thereto can be stuck by way of its under side onto a transition region (between the first and the second label portion), which is one winding deeper. For example, the transition region can be provided on the front side with a anti-adhesive coating and the end-side edge region of the first label portion can be adhesive on the rear side (or vice versa). This means that the end-side edge region can be stuck in a reversible manner onto the transition region, i.e. can, be peeled off again afterwards. Otherwise, however, the first label portion is non-adhesive over a large surface area on its rear side such that once the end-side edge region has been peeled off, the entire first label portion can be raised to form a protruding flag. In this state, the first label portion with the warning printed thereon certainly catches the eye of the medical expert.

It is preferably provided that the first label portion has a pull tab at the end, by way of which the material web can be peeled off at the end in the region of the first label portion. The pull tab can, for example, form the end-side edge region in the longitudinal direction or alternatively in the vertical direction, i.e. can project beyond the other dimensions of the label in the transverse direction with respect to the longitudinal direction. In particular in the case of an ampoule or a vial, the pull tab, in the latter case, is able to be gripped easily at the neck or at the constriction of the receptacle.

It is preferably provided that the first label portion, along the longitudinal direction of the label along which the label is to be rolled off for dispensing, forms an end portion that assumes between 35% and 50% of the length of the material web of the label. For example, the length of label can correspond approximately to 2.25 times the circumference of the container to be labelled. In this case, the first label portion (in particular when it runs once fully around the circumference) assumes four ninths of the entire label length.

It is preferably provided that the spare label is defined in the material web of the label by a perforation, punched line or other tear line. This means that the spare label can be formed as an integral component of the actual base surface of the label. In particular, the spare label can be incorporated into the basic dimensions of the label film without the spare label having had to protrude or project completely or predominantly beyond an edge of the main label. Instead of which, the spare label is situated preferably in a central region of the material web punched according to the basic form of the label.

A anti-adhesive coating is preferably provided in a transition region between the first label portion and the second label portion, for example in the form of a silicone coating or a coating containing silicone. This makes possible the re-sealable sticking of an end-side edge region of the first label portion from outside onto the front side of the transition region.

It is preferably provided that the spare label is non-adhesive on the rear side in a first surface portion that is remote from the first label portion along the longitudinal direction of the material web. Said first surface portion of the spare label can assume, for example, between 30% and 80% of the basic surface of the spare label and is situated in a region of the spare label that is different from the first label portion. Said first surface portion, once the spare label has been dispensed onto a syringe, forms a small protruding flag (on the spare label) that can be printed and/or written on by hand on both sides. In particular, such information that in the case of individual treatment is to be noted on the reference label by the medical staff on site in their own hand to identify a syringe, can be noted on the front side or the rear side of the first surface region of the dispensed spare label. The first surface region is preferably approximately as large as the remaining part of the spare label.

In addition, it is preferably provided that, in a further, second surface portion, which is arranged closer to the first label portion along the longitudinal direction of the material web than the first surface portion, the spare label is adhesive on the rear side. The adhesive region on the rear side serves for attachment to the syringe and even more information can be carried on the front side.

The material web, from which the entire label and consequently also the spare label is formed, is preferably a film, in particular a plastics material film.

In addition, it is preferably provided that the spare label, at the end side close to an edge of the spare label that is arranged along the longitudinal direction close to the first label portion of the label, has a pull tab for peeling-off the spare label. As, where the label has been produced but not yet dispensed, the first label portion of the spare label, that can be used as a small inscribable flag, points away from the first label portion of the entire label, the additional pull tab, which is arranged on the end of the spare label facing the first label portion, makes it easier to grip or detach the spare label from the entire label. The pull tab of the spare label can consist, for example, of a rounded edge of the spare label in the direction of the first label portion; on the rounded edge, the spare label can be non-adhesive on the under side within the range of a few millimetres and consequently can protrude from the circumference of the labelled object once the first label portion has been opened. As an alternative to this, the pull tab of the spare label can project in the vertical direction, i.e. transversely with respect to the longitudinal direction of the main label, beyond the dimensions of the predominant part of the main label. For example, the pull tab can project upward in the vertical direction as far as the constriction or as far as the neck of the liquid container, from where the perforation or other tear line in the material web can easily be torn.

It is preferably provided that the spare label, in the vertical direction transversely with respect to the longitudinal direction of the label, extends up to precisely one of two outside edges of the label. Consequently, the spare label extends, for example, to the upper edge of the circumferential entire label, but not to the lower edge thereof. Through this asymmetrical arrangement, there is a larger contiguous surface available below the spare label sufficient for a single-line or even multiple-line inscription. The spare label is then connected to the remaining label on three sides by means of a perforation or other tear line. In addition, the remaining continuous region of the second label portion can absorb the tensile load when the label is dispensed and when the spare label is peeled off.

It is preferably provided that along the longitudinal direction of the label, the anti-adhesive coating provided on the front side on the third label portion has a dimension that is at least as large as the dimension of the second surface portion of the spare label that is adhesive on the rear side. This means that, when the entire label is dispensed, the surface portion of the spare label that is adhesive on the rear side comes to rest completely on the anti-adhesive coating and consequently can easily be peeled off. The spare label, however, has on the other side, additionally, another non-adhesive surface portion which consequently (when the overall label is dispensed) can be placed directly onto the outer circumference of the container to be labelled itself without it also being necessary to provide the third label portion, provided with the anti-adhesive coating (or an extended continuation of said third label portion), between the underside of the non-adhesive surface portion of the spare label and the outer circumference of the container. This means that, where the length of the entire label is the same, the spare label can be considerably longer in the longitudinal direction than in the past. Once the entire label has been dispensed on the liquid drug container (for instance an ampoule), the spare label can consequently project in the circumferential or longitudinal direction far beyond the third label portion and the anti-adhesive coating thereof provided on the front side and can be realized considerably longer in comparison thereto (for example twice, three times or even four times as long, for example with a length that corresponds to the entire outer circumference of the ampoule). Once the spare label has been detached from the ampoule and attached to a syringe (the spare label now serving as the reference label thereof), the surface portion of the spare label that is not adhesive on the rear side then forms a small protruding flag which results in a considerably larger inscription surface (on the spare label) compared to traditional reference labels and which is also suitable, in particular, for subsequent inscription by hand.

The reference label is preferably transparent. In particular, the entire label can be transparent or formed from a transparent film. The film can be printed in a regional manner with a background colour, which can be recessed in a regional manner (for instance in the region of the spare label, the adhesive surface portion thereof and/or the non-adhesive surface portion thereof).

The dimension of the anti-adhesive coating of the third label portion, measured in the longitudinal direction of the label, should be at least as large as the length of the second surface portion of the spare label that is adhesive on the rear side, measured in the identical direction.

With the aid of the label realized according to the invention, a container for a liquid drug is able to be identified with a greater number of items of information and, in addition, is able to be labelled in a manner that is more cost-saving than in the case of traditional labels.

Moreover, the label preferably has precisely one spare label and is consequently suitable, in particular, for single-dose containers.

The invention consequently also provides a container for a liquid drug, said container having an outside surface, onto the circumference of which the label according to the invention is applied.

It is preferably provided that the present wrap-around label is stuck around the circumference of the container and goes around the circumference of the container between two times and two and a half times. As liquid containers for medical liquids (ampoules or vials) are usually standardized, the label length can be matched to these standard containers. If the first label portion that can be raised as a flag runs around the container circumference preferably once completely, the length of the label measured in the longitudinal direction should correspond overall to twice or three times the container circumference. In so far as the spare label also surrounds the container circumference almost completely and the second surface portion of the spare label that is adhesive on the rear side assumes, for instance, half the container circumference, the third label portion that is siliconized on the front side or has its adhesion reduced in another way can also be provided with a length that corresponds to half the container circumference. In this case, a label length is produced that corresponds to 2.5 times the container circumference. As, however, the rear side of the spare label does not necessarily have to be adhesive over a length of half the container circumference and also the spare label overall does not have to run completely around the circumference of the container, a length of the overall label that corresponds to 2.25 times the container circumference is sufficient in practice. The label length can also be selected to be even smaller, depending on the desired design of the spare label and on the length of the flag formed by the first label portion and inscribable on both sides. However, it is preferably provided that the first label portion on the labelled container has a length that corresponds to the circumference of the container, and that the spare label is covered completely by the first label portion.

In addition, it is preferably provided that the third label portion, provided on the front side with the anti-adhesive coating, is covered by the second surface portion of the spare label that is adhesive on the rear side. In addition, it can be provided that the length of the spare label also corresponds to the circumference of the container. The outside surface of the container is preferably cylindrical, in particular circular cylindrical. The container for the liquid drug is preferably a vial, an ampoule or another transparent container for a liquid drug that preferably is produced predominantly from glass. The container provided with the label according to the invention is, in particular, a container for a single dose of a liquid drug; in the case of such single-dose receptacles with only a few milliliters of liquid, the receptacle diameter is particularly small (as a rule smaller than 1 cm) and the circumferential surface available for inscription is consequently even more limited. By using the label according to the invention, however, the useful inscription surface is clearly increased. This makes it possible to print the container identifications (including possible administering instructions and warnings) in a more clearly readable, more detailed and more complete manner than on liquid containers provided with traditional labels.

Finally, it is preferably provided that the spare label is a label for a syringe for injecting the liquid drug.

BRIEF DESCRIPTION OF THE DRAWINGS

Some exemplary embodiments are described below with reference to the Figures, in which.

DETAILED DESCRIPTION OF PREFERRED EMBODIMENTS

Figure 1:
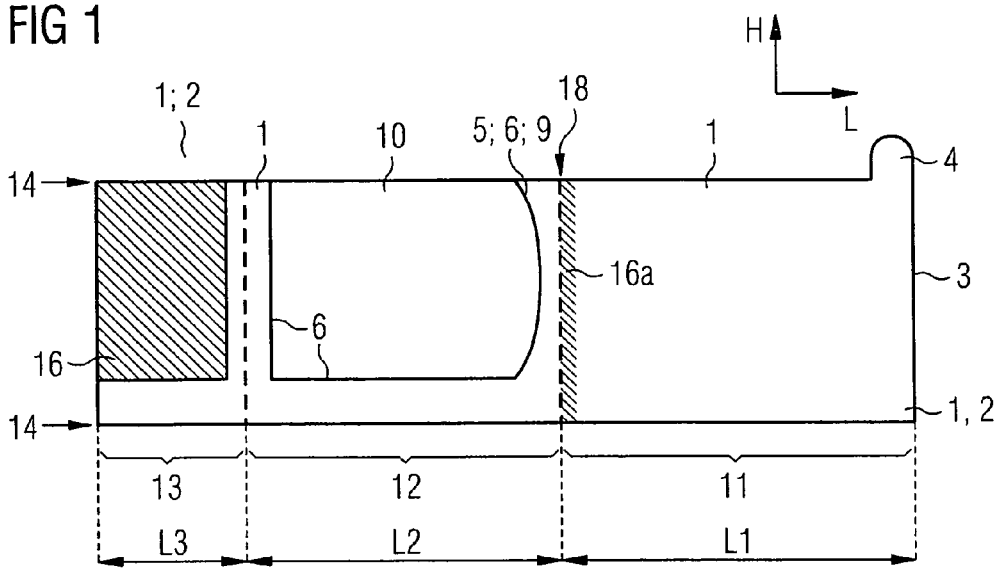
FIG. 1 shows a schematic top view of the front side of an embodiment of a label according to the invention.

FIG. 1 shows a schematic top view of an exemplary embodiment of a label according to the invention. The label 1 is a wrap-around label to be wrapped more than once around a cylindrical, in particular circular cylindrical, circumferential surface of an object, preferably of a container for a liquid drug. The label is a single-layer label with only one single film or material web 2 that is shown in FIG. 1 from its front side, that is to say from the subsequent outer side. Corresponding to the main application for dispensing to liquid containers such as ampoules or vials, in which, typically, quantities of a few milliliters of a liquid drug are kept, the present wrap-around label extends mainly along the longitudinal direction L, which corresponds to the subsequent circumferential direction along the circumference of the liquid container. The label 1 has a first 11, a second 12 and a third label portion 13, the first label portion 11 being arranged on such an end-side edge region 3 which is rolled out last onto the container circumference when being dispensed and consequently remains visible from the outside. Accordingly, the length L1 of the first label portion 11 in the longitudinal direction L is preferably identical or approximately identical to the circumference of the labelled container.

In a central region of the label 1 is situated a spare label 10 that is detachable from the dispensed entire label 1 in order to identify a filled syringe. The spare label 10, however, is not stuck to the material web 2 or applied in any other way, but forms an integral component of the single-layer material web 2 of the label. The spare label 10 is separated from the remaining regions of the entire label by at least one tear line 6. The tear line 6 (shown in FIG. 1 as a continuous, uninterrupted line) can be, for example, a perforation or punched line etc., which makes possible a subsequent detaching of the spare label 10. Consequently, the single-layer entire label 1 at the same time forms a "mother label" for a subsequently detachable "daughter label", namely the spare label 10.

In addition, the spare label 10 is clearly spaced from the end-side edge region 3 and, consequently, is not directly grippable or visible from the outside on the dispensed label. Instead of which, the spare label is arranged outside the first, outer label portion 11 of the length L1; it is situated, consequently, in a second, central label portion 12 of the length L2. When wound onto the liquid container, the lengths L1 and L2 correspond in the circumferential direction preferably approximately to the circumference of the liquid container. In this case, the second label portion 12 is covered on the outside by the first label portion 11 as the entire label is wound around the container in a spiral manner lengthways in the longitudinal direction L. In this case, the end-side edge region 3 comes to rest on the circumference last and then overlaps or covers the transition region 18.

During dispensing, the opposite end of the label 1 is rolled out first of all; this is where the third label portion 13 is situated as in FIG. 1. This has a length L3 that is, for example, a quarter as large or half as large as the circumference of the labelled container. The length L3 is preferably at least approximately half as large as the length of the spare label 10. The third label portion 13 serves namely as a substrate for at least one part of the spare label (in FIG. 1 for its right-hand half which is adhesive on the underside) and is consequently provided on the outside, as shown in FIG. 1, with a anti-adhesive coating 16, for example, a silicone coating or another silicone treatment. As, on the label dispensed in a spiral manner, the adhesive region of the underside of the spare label 10 comes to rest on this anti-adhesive coating 16, the spare label 10 is easily detachable from its substrate.

A further anti-adhesive coating 16 that is applied at least in places is provided in a transition region 18 on the outside between the first and the second label portion 11, 12. This anti-adhesive coating serves as a substrate for the end-side edge region 3, which is preferably adhesive on its underside. By means of the anti-adhesive coating, the label can consequently be detached more easily from its end-side edge region 3.

The label in FIG. 1 is preferably formed by a plastics or polymer material film, which provides the single material layer that is decisive for the shaping and dimensional stability of the label. The plastics or polymer material film is preferably transparent. The spare label, in particular, is transparent. At the same time, however, the entire label can also be non-transparent in regions, for example with the aid of a colour layer that is printed on or applied in another way. This is suitable as background colour for printing or other inscription. In addition, the applied colour layer enables the printing of the label in regions on both sides. The entire label is preferably transparent in the region of the spare label 10 or of one of the two surface regions thereof 7, 8 (at least in regions) and is consequently free of a non-transparent colour layer.

Figure 2:
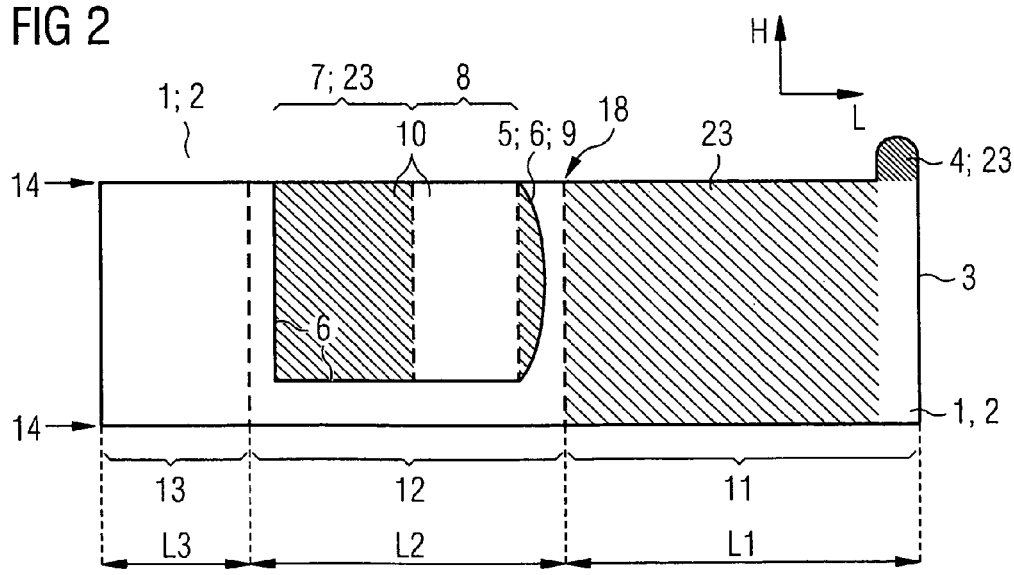
FIG. 2 shows a further schematic top view of the front side of the label in FIG. 1, but with identification of the regions on the rear side that are adhesive and non-adhesive.

FIG. 2 shows a further schematic top view of the front side of the label in FIG. 1. In addition, however, FIG. 2 shows where adhesive and non-adhesive regions are located in each case on the rear side of the label 1. The non-adhesive regions are shown in FIG. 2 in a hatched manner.

According to FIG. 2, the underside or rear side of the first label portion 11, in particular, is non-adhesive over a large surface region, as can be seen by way of the hatching. Consequently, once it has been opened at the end-side edge region 3, the first label portion 11 can be rolled out from the container circumference; it then forms a protruding flag, which can be printed on both sides with information for the container identification, with warnings, administering instructions, bar codes, alphanumeric characters or any other additional specifications. Consequently, purely through the first label portion 11, there is already twice the container circumference available as an inscribable surface.

The spare label 10 that had initially been covered by the first label portion 11, is located in the second label portion 12 appearing below. The spare label 10 does not necessarily have to assume the entire height and/or length of the second label portion 12. For example, the spare label 10 only needs to reach as far as one of the two outside edges 14 that define the label 1 in the vertical direction H. The dimension of the spare label 10 in the longitudinal direction L can correspond to the circumference of the labelled container or can be even smaller. On the side remote from the first label portion 11, there is a larger contiguous region of the spare label 10 that is non-adhesive on the rear side. Once the spare label 10 has been detached and attached to a syringe, this first surface portion 7 can be used as a small protruding flag that can be printed on both sides and/or subsequently written on by hand.

A second surface portion 8 of the spare label 10, which is non-adhesive on the rear side—just as the regions of the second label portion 12 and of the third label portion 13 surrounding the spare label 10—, is situated in FIG. 1 closer to the first label portion 11. The second surface portion 8 of the spare label 10 is consequently used for sticking onto a syringe (preferably on the syringe circumference thereof).

FIG. 2 also shows, on the right-hand side of the spare label 10, a region formed by a curved or rounded edge 9, which is also non-adhesive on the underside; it serves as pull tab 5 for the spare label 10 that is to be peeled off.

As mentioned, the first label portion 11 is also non-adhesive over a large surface area on the rear side. This does not exclude the fact that a narrow strip along the end-side edge region 3 on the rear side is adhesive in order to stick onto the outermost end of the label 1 in the longitudinal direction L (i.e. the right-hand one in FIG. 2), so that it does not become detached on its own from the substrate, in particular from the transition region 18 between the first 11 and the second label portion 12. To make opening the first label portion 11 easier, a pull tab 4 is preferably realized—either as shown in the vertical direction H above an outside edge 14 of the further label 1 or, similarly to the pull tab 5 of the spare label 10, as an end closure protruding in the circumferential direction at the end of the edge region 3. In a reverse manner, the pull tab 5 of the spare label 10 can be arranged in an identical manner to the pull tab 4 of the first label portion 11 on an outside edge 14 of the entire label and can project above this edge in the vertical direction H. In particular in the case of a vial, the pull tabs 4, 5 protruding upward in this manner are able to be gripped more easily on the narrowed neck. The initially covered arrangement of the pull tab 5 of the spare label 10 as in FIGS. 1 and 2, which is surrounded by the first label portion 11 in a cylindrical manner on the dispensed label, however, advantageously prevents the spare label being inadvertently pulled before the first label portion 11 of the entire label 1 is opened and protrudes as a flag.

In so far as the entire material web 2 of the label 1 has an adhesive or an adhesive coating on its rear side, an adhesive covering can be provided on the rear side in the regions 23 of the first label portion 11, of the first surface portion 7 of the spare label 10 and possibly of the pull tabs 4, 5. If, as an alternative, the material web 2 of the label is only coated with an adhesive layer on the rear side in places, said adhesive layer must be recessed on the rear side of the first label portion 11 and of the first surface portion 7 of the spare label 10 (and on the pull tabs 4, 5), i.e. in the non-adhesive regions 23.

In both cases, however, this results in the underside of the label 1 in the region of the second label portion 12 outside the spare label 10, in the third label portion 13, in the second surface portion 8 of the spare label 10 and preferably also on a narrow, for example strip-shaped area close to the outermost end edge region 3 being adhesive.

Where the container circumference is wrapped around in a spiral manner, the second surface portion 8 of the spare label 10 that is adhesive on the rear side comes to rest on the silicone treatment or other type of anti-adhesive coating 16 (FIG. 1) on the upper side of the third label portion 13. The remaining surface regions of the material web 2 of the label 10, however, come to lie either on the container circumference itself or on another part region of the label 10 wound around them. In addition, a further local anti-adhesive coating 16a of a smaller basic area can be provided in the transition region 18 between the label portions 11 and 12, for example in the form of a plurality of punctiform, approximately circular disc-like coating pieces, depending on the desired strength of the reduction in adhesive force on the rear side of the end-side edge region 3.

In contrast to traditional labels, in particular those produced from only one single material web, the advantage provided by the present embodiment of the label is that considerably more inscription surface is available. In particular, the first label portion 11 can be inscribed, in particular can be printed on, both on the front side and on the rear side. In addition, the label 1 can be printed on in the region of the second label portion 12 on the front side, the information printed in the region of the spare label 10 that is to be detached being intended for the syringe that is to be filled. However, also on the spare label 10, the first surface portion 7 can also be printed on on the rear side or can be written on subsequently by hand on the front side and/or on the rear side.

The length L1 of the first label portion 11 (and in addition also the length L2 of the second label portion 12) preferably corresponds to the container circumference. The flag formed when the first label portion 11 is opened at the end exposes the second label portion 12 with the spare label 10. The third label portion 13 does not appear, however, until the spare label 10 has been detached. However, it can also include an inscription.

Figure 3:
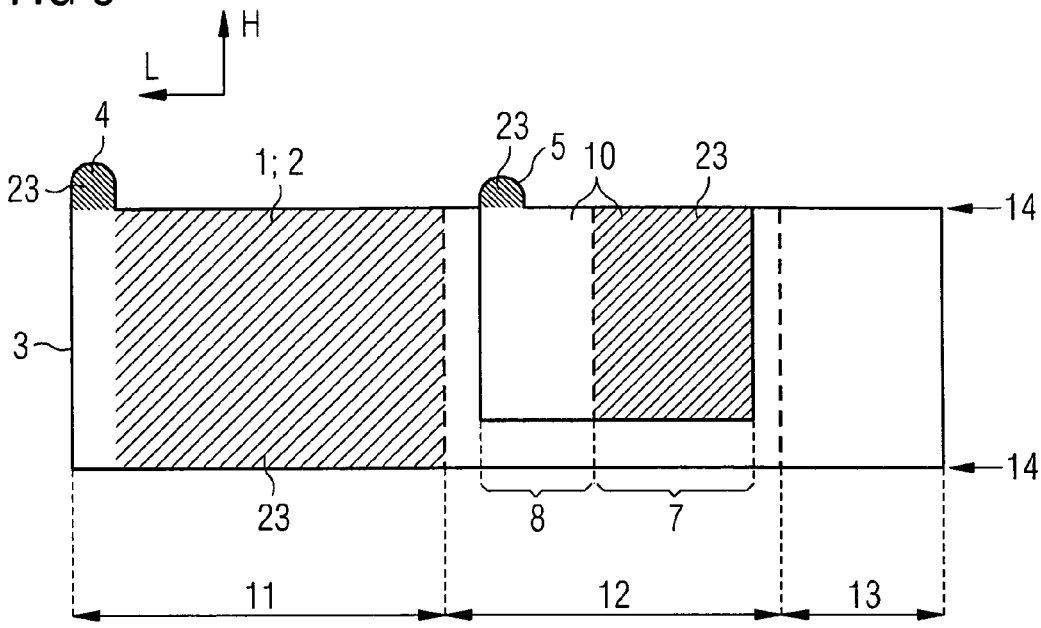
FIG. 3 shows a schematic top view of the rear side of the label in FIG. 1 and FIG. 2.

FIG. 3 shows a schematic top view of the rear side of the label from FIGS. 1 and 2. Purely for the purposes of illustrating an alternative embodiment with regard to the pull tab 5 of the spare label 10, this has not been shown projecting in the circumferential direction as in FIG. 1 and FIG. 2, but rather as a projection above an upper outside edge 14 along the vertical direction H. Otherwise, however, the rear view in FIG. 3 corresponds to the front view in FIGS. 1 and 2 and is correspondingly shown in a mirror-inverted manner. The surface regions of the rear side shown by the hatching specify where the rear side of the label 1 is not adhesive. For example, the non-adhesive regions 23 on the rear side can have corresponding adhesive coverings; in particular the first label portion 11, the first surface portion 7 of the spare label 10 and/or the pull tabs 4 and 5 can be non-adhesive on the rear side.

Figure 4:
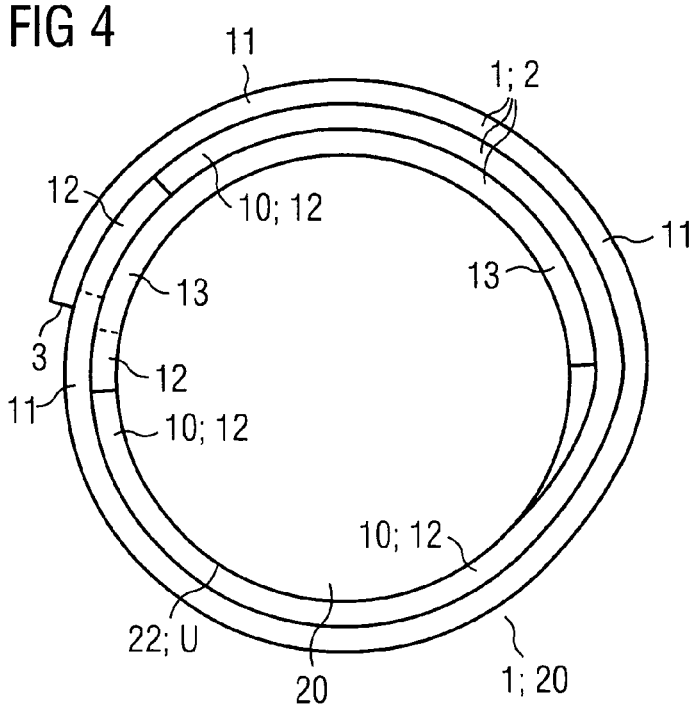
FIG. 4 shows a label as in FIGS. 1 to 3 stuck-on around a container for a liquid drug and FIG. 5 shows the label in FIG. 4 wound around the container in the state after a first label portion has been raised.

FIG. 4 shows the label 1 from FIGS. 1 to 3 stuck onto a container 20 for a liquid drug (preferably an ampoule or a vial). The label 1 is wound along the circumference U of the container 20 around the outside surface 22 thereof, which is preferably cylindrical, in particular circular cylindrical. The container 20, wound around with the label 1, is shown in FIG. 4 viewed from the axial direction of symmetry, in a schematic cross sectional view at a height at which the spare label 10 is also situated. The label 1 shown in FIG. 4 has been wound in a spiral manner anti-clockwise around the circumference U of the container 20, the third label portion 13 coming to lie as the first element on the outside surface 22 of the container 20.

The anti-adhesive coating 16 (FIG. 1) is arranged on the upper side (or now outside) of the third label portion 13. The transitions from the third label portion 13 to the second label portion 12 and from the second label portion 12 to the first label portion 11 are indicated in FIG. 4 by dotted lines. In addition, the tear lines 6, which surround the cutout of the material layer 2 or of the label 1 that is to be subsequently torn off as spare label 10, are shown by continuous lines; there the material layer 2 of the label 1 is interrupted along the axial direction, however at most in places.

The spare label 10 sticks partially to the circumferential surface of the container 20, but covers, at least by way of its second surface portion 8 that is adhesive on the rear side, the anti-adhesive coating 16 (FIG. 1) of the third label portion 13. The first label portion 11, which can optionally be stuck at the end edge region 3 thereof onto the transition region or another place of the label, connects thereto. Otherwise, however, the first label portion 11 is non-adhesive over a large surface area on its underside such that it forms a protruding, two-sided inscripted flag no later than after the detaching of the end-side edge region 3. In particular when the length of said flag corresponds to the circumference U of the container 20, just purely on account of the first label portion 11 twice the amount of inscription surface is available than was available previously, without the label, just on the container 20 itself.

Figure 5:
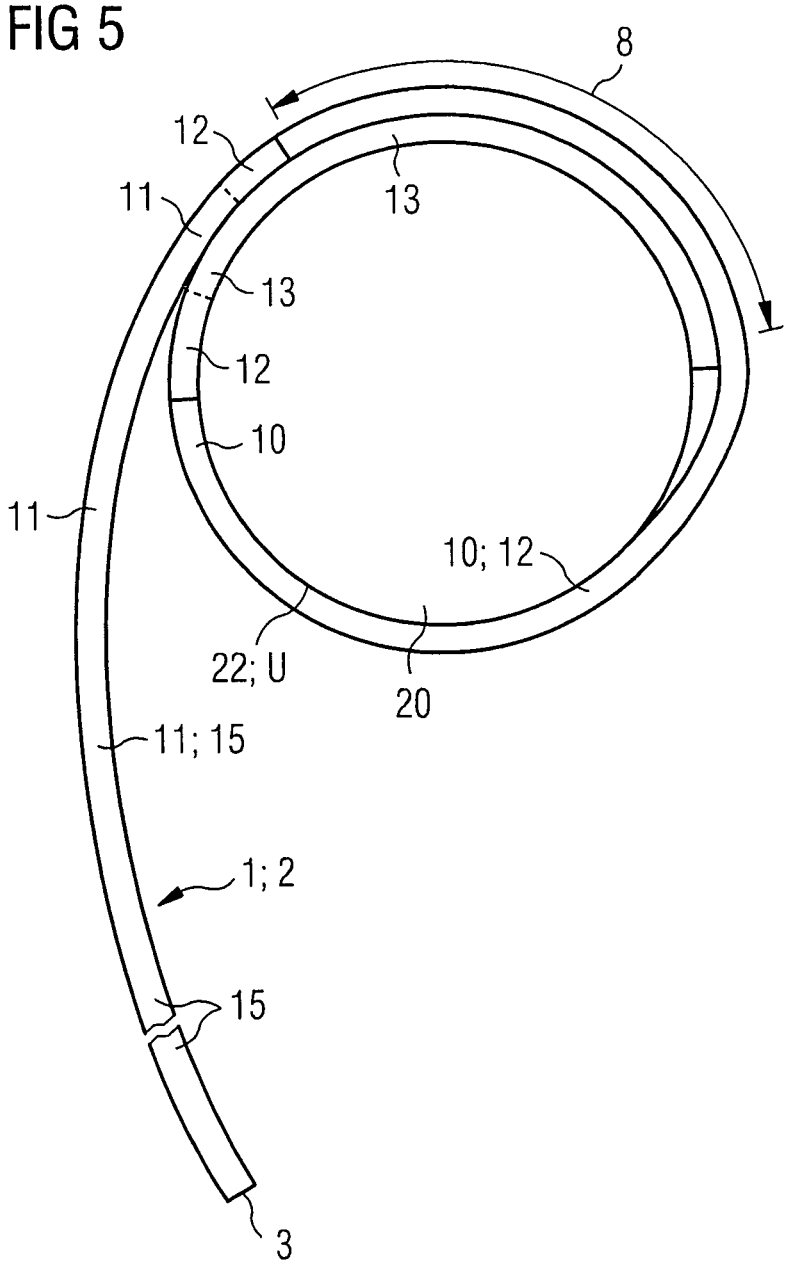

FIG. 5 shows the label 1 from FIG. 4 wound around the container 20, but in the state after the first label portion 11 has been raised. The first label portion 11 then forms a protruding flag 15 that is printed on or inscribed in another way on both sides. The length of the protruding flag 15 preferably corresponds to the outer circumference U of the container 20.

As in FIG. 5 the first label portion 11 protrudes as flag 15, the second label portion 12 with the spare label 10 is now free. Further inscription parts can be arranged there, the inscription of the spare label 10 being intended to identify a syringe once said syringe has been filled with a liquid drug.

As can be seen in FIG. 5, only the surface portion 8 of the spare label that is adhesive on the rear side needs to come to rest on the third label portion 13 (provided with the anti-adhesive coating 16 on the front side); consequently the spare label 10 can be considerably longer and, in particular, can also have another further surface portion which is non-adhesive on the underside (the first surface portion 7; FIGS. 2 and 3) and which, when the label 1 is dispensed, comes to rest directly on the circumference U of the outside surface 22 of the container 20. This means that the entire label can also be dispensed on container 20, the circumference U of which is greater than the length L3 of the anti-adhesive coating 16, but smaller than the sum of the length L3 of the anti-adhesive coating 16 and the length of the spare label 10 (in each case in the longitudinal direction or circumferential direction). In particular, the entire label can be dispensed on container 20 with such a container circumference U that is greater than the length L3 of the anti-adhesive coating 16 of the third label portion 13, but is smaller than the sum of the length L3 of the anti-adhesive coating 16 and the length of the first surface portion 7 of the spare label 10 (that is non-adhesive on the underside).

The entire label 1 in FIGS. 1 to 5 comprises only or consists only of one single material web 2 and can consequently be produced in a particularly cost-efficient manner. The label 1 can run around the circumference U of the container 20 for example 2.25 times. It is not possible to provide an inscription surface on a container that is approximately as large using traditional labels with comparably low production costs.

What is claimed is:

1. A label for sticking onto a container for a liquid drug, wherein the label is a single-layer wrap-around label for wrapping around a circumference of a container;

wherein said label has a first label portion, a second label portion, and a third label portion, wherein said second label portion is arranged between said first label portion and said third label portion;

wherein the label has a spare label that is arranged in the second label portion and that forms a part portion of the label;

which part portion is defined in the label by a tear line on at least two sides and which part portion is detachable, once the label is stuck onto a container, from the label and from the container and is attachable to a further object;

wherein the first label portion is designed for completely covering the spare label;

wherein the label is designed such that at least a surface portion of the spare label is configured to cover the third label portion;

wherein the spare label is non-adhesive, on its rear side, in a first surface portion that is arranged, in a longitudinal direction of the label, remote from the first label portion; and wherein the spare label is adhesive on its rear side in a further, second surface portion that is arranged, in the longitudinal direction, closer to the first label portion than the first surface portion.

2. The label according to claim 1, wherein said third label portion, is arranged at an end of the label opposite to the first label portion, and has a front side and a rear side with an adhesive on the rear side and is provided on the front side at least in regions with an anti-adhesive coating.

3. The label according to claim 1, wherein the first label portion is configured to be printed on both sides and is non-adhesive over a large surface area on its rear side.

4. The label according to claim 1, wherein along the longitudinal direction of the label, the length of the first label portion is dimensioned such that the first label portion completely encircles the circumference of the container to be labelled and the spare label is not exposable until the first label portion has been raised.

5. The label according to claim 1, wherein the label is realized such that it further comprises an adhesive on an edge region at the end of the first label portion, wherein said first label portion is re-sealable, via said adhesive on the rear side.

6. The label according to claim 1, wherein the first label portion has a pull tab at the end, by way of which the label can be peeled off at the end in the region of the first label portion.

7. The label according to claim 1, wherein the label is provided on the front side with an anti-adhesive coating in a transition region between the first label portion and the second label portion.

8. The label according to claim 7, wherein along the longitudinal direction of the label, the anti-adhesive coating provided on the front side of the third label portion has a dimension that is at least as large as the dimension of the second surface portion of the spare label that is adhesive on the rear side.

9. The label according to claim 1, wherein the tear line is a perforation or a punched line.

10. The label according to claim 1, wherein the spare label, in the direction transversely with respect to the longitudinal direction of the label, extends up to precisely one of two outside edges of the label.

11. The label according to claim 1, wherein the spare label, has an edge facing the first label portion, and further comprises a pull tab wherein the pull tab is at least partially non-adhesive on its underside so as to protrude from the circumference of a labeled object once the first label portion has been opened.

12. A container for a liquid comprising:

an outside surface;

a label sticking onto a the container, wherein the label is a single-layer wrap-around label wrapped around a circumference of the outside surface of the container;

wherein said label has a first label portion, a second label portion, and a third label portion, wherein said second label portion is arranged between said first label portion and said third label portion;

wherein the label has a spare label that is arranged in the second label portion and that forms a detachable part portion of the label;

which part portion is defined in the label by a tear line on at least two sides and which part portion is detachable from the label and from the container and is attachable to a further object;

wherein the first label portion is designed for completely covering the spare label;

wherein at least a surface portion of the spare label covers the third label portion;

wherein the spare label is non-adhesive, on its rear side, in a first surface portion that is arranged, in a longitudinal direction of the label, remote from the first label portion; and wherein the spare label is adhesive on its rear side in a further, second surface portion that is arranged, in the longitudinal direction, closer to the first label portion than the first surface portion.

13. The container according to claim 12, wherein the label is stuck around the circumference of the container and goes around the circumference of the container between two times and two and a half times.

14. The container according to claim 12, wherein the container is a receptacle for a single dose of liquid drug.

15. The container according to claim 12, wherein the container is a vial or an ampoule.

16. A label for sticking onto a container for a liquid drug, wherein the label is a single-layer wrap-around label for wrapping around a circumference of a container, wherein said label has a first label portion, a second label portion, and a third label portion, wherein said second label portion is arranged between said first label portion and said third label portion, wherein the label has a spare label that is arranged in the second label portion and forms a part portion of the label, and wherein the first label portion is designed for completely covering the spare label which part portion is defined in the label by a tear line, on at least two sides; and which part portion is detachable, once the label is stuck onto a container, from the label and from the container, and is attachable to a further object;

wherein the label is designed such that at least a surface portion of the spare label is configured to cover the third label portion;

wherein the spare label is non-adhesive, on its rear side, in a first surface portion that is arranged, in a longitudinal direction of the label, remote from the first label portion; and wherein the spare label is adhesive on its rear side in a further, second surface portion that is arranged, in the longitudinal direction, closer to the first label portion than the first surface portion.

* * * * *